US009402119B2

(12) United States Patent
Contreras Hernández et al.

(10) Patent No.: US 9,402,119 B2
(45) Date of Patent: Jul. 26, 2016

(54) COMMUNICATION SYSTEM IN RESPIRATORY PROTECTION MASKS

(71) Applicant: Ingeniera, Computación Y Comunicaciones Solunova Ltda., Santiago (CL)

(72) Inventors: Mauricio Andrés Contreras Hernández, Santiago (CL); Jorge Ignacio Morales Undurrage, Santiago (CL)

(73) Assignee: INGENIERIA, COMPUTACION Y COMUNICACIONES SOLUNOVA LTDA., Santiago (CL)

( * ) Notice: Subject to any disclaimer, the term of this patent is extended or adjusted under 35 U.S.C. 154(b) by 0 days.

(21) Appl. No.: 14/358,249

(22) PCT Filed: Nov. 15, 2012

(86) PCT No.: PCT/CL2012/000068
§ 371 (c)(1),
(2) Date: Jul. 6, 2015

(87) PCT Pub. No.: WO2013/071458
PCT Pub. Date: May 23, 2013

(65) Prior Publication Data

US 2015/0312664 A1 Oct. 29, 2015

(30) Foreign Application Priority Data

Nov. 15, 2011 (CL) ..... 2875-2011

(51) Int. Cl.
*H04R 1/08* (2006.01)

(52) U.S. Cl.
CPC ..... *H04R 1/083* (2013.01); *H04R 2201/023* (2013.01); *H04R 2499/10* (2013.01)

(58) Field of Classification Search
CPC .... H04R 1/10; H04R 2205/022; H04R 1/105; H04R 5/0335; H04R 2201/10
USPC ..... 381/370, 374, 375, 376; 128/864, 867
See application file for complete search history.

(56) References Cited

U.S. PATENT DOCUMENTS 4,718,415 A * 1/1988 Bolnberger ..... H04R 1/083 381/375

(Continued)

*Primary Examiner* — Suhan Ni
(74) *Attorney, Agent, or Firm* — Ballew Law

(57) ABSTRACT

A communication system provided with a voice vibration adapter and microphone housing of electronic components, for respiratory protection equipment or the like, provided with means of transmission and reception, both connected either wired or wireless, in charge of allowing voice transmission fluently and clearly, in places of high acoustic index and of hazardous polluting emissions, preventing the worker from removing the protective equipment to communicate, characterized by means of voice vibration adapter (3), consists of a prismatic hollow outer body with lateral grooves (8) and a front oblong perimeter protrusion (9), inside which there is an isolating cavity (10) for receiving a microphone (1), followed by another smaller cavity (11) for acoustic resonance, which is connected to another cavity greater than the above (12), for electronic components' plate housing (2), also said voice vibration adapter (3), has an output duct (13) of a two-channel connection cable channels (14), which connects with the headset (6) and finally presents a lower perpendicular neck recess (15) of the area or lower base of the voice vibration adapter (3), which is assembled on a lower hollow neck (16), located in the upper base respiration part (4), which is assembled and fixed with the front face of a breathing mask (5).

20 Claims, 4 Drawing Sheets

(56) References Cited

U.S. PATENT DOCUMENTS 4,980,926 A * 12/1990 Noetzel ..... A42B 3/30
381/375
5,572,990 A * 11/1996 Berlin ..... A62B 18/08
128/201.19
5,574,794 A * 11/1996 Valley ..... H04R 1/08
381/361
6,104,816 A * 8/2000 Downs, Jr. ..... H04B 1/385
381/375
7,130,439 B2 * 10/2006 Chen ..... H04R 1/083
381/375
7,464,705 B2 * 12/2008 Tanizawa ..... A62B 18/006
128/201.23
7,477,207 B2 * 1/2009 Estep ..... B63C 11/12
345/7

* cited by examiner

COMMUNICATION SYSTEM IN RESPIRATORY PROTECTION MASKS

BACKGROUND OF THE INVENTION

The invention relates to a communication system, for respiratory protection equipment or the like, provided with means for transmitting and receiving both connected (either wired or wireless), in charge of allowing effective communication between two or more people, said means allowing a clear and fluid communication with any receiver in locations with high incidence and high acoustic emissions, threatening the health of workers, preventing them to shed security teams to communicate, thus maintaining worker safety effectively according to the rules, which is not currently happening in hazardous work and a lot of noise pollution.

Personal protective equipment must comply with the community provisions on design and construction safety and health that affect it. In any case, personal protective equipment shall:

a) Be appropriate to the risks that have to be protected, without assuming itself a risk;
b) Respond to conditions in the workplace;
c) Take account of ergonomic requirements and worker health,
d) Fit the wearer correctly after any necessary adjustments.

In the presence of multiple hazards that require to wear simultaneously more personal protective equipment, such equipment shall be consistent and maintain their effectiveness in relation to the risk or risks in question.

The conditions under which personal protective equipment should be used, particularly regarding the time during which it is to be, will be determined based on the severity of the risk, frequency of exposure to risk and job characteristics of each employee as well as the performance of personal protective equipment.

The personal protective equipment are intended, in principle, for personal use.

If circumstances require the use of an individual computer for several people, appropriate measures must be taken to ensure that such use does not cause any health or hygiene issues to the different users.

Consequences in Terms of Security

Injuries arising from the worker by moving objects, material shedding, etc.

Injuries caused by crushing.

Injuries caused by striking objects

Consequences of Workload

Accidents:

Mental Fatigue (irritability, nervousness, depression, anxiety, etc.).

Market solutions to similar problems exist, such as based on the use of throat microphones, which can be used without need to take off the face mask. However, the use of this third element is problematic in environments targeted, since it is usual that employees there use already a large amount of equipment. The same happens in microphones that are attached to masks.

From the point of view of the audio signal, there are systems that enable local communication, emulating natural speech. Such is the case of microphones attached to the masks that provide an audio signal to a speaker worn by the operator, or phonic masks valves, which allow the output of the voice to the outside thereof. However, these systems "local audio" are not effective in communication in places with high decibels of noise and unpleasant sounds, resulting in potential recipients to continue removing their hearing protection. When sending the audio signal electrically from inside the mask (transmitter) this presents a significant attenuation of ambient noise, and when delivered within hearing protection, the receiver does not need to shed their means of protection.

Currently, to communicate in dangerous or high acoustic index, workers removed their masks (transmitter) and hearing protection (receiver), which goes against the very purpose of these protections. While this may occur for only short times on each occasion, the effect can be cumulative, causing occupational diseases such as silicosis or other diseases and can also be fatal in places with hazardous pollutant emissions.

The voice transmission communication system of the present invention can incorporate a set of electronic media, which can be easily adapted in safety equipment or the like, in order to maintain communicated and controlled the workers performing high-risk tasks or where it is not possible to communicate interpersonally. The group of media send forth a standard audio signal (input and output), consistent with a number of electronic devices transceiving (transmission/reception), as portable radios, cell phones, computers, and general audio equipment. Thus, the worker can communicate securely and smoothly with any recipient.

A comprehensive study on the Microphone Adapter was performed, to deliver high-end quality audio, both from a design and electronics perspective. A research has also been done regarding the interfaces with other third party systems, in such a way to give the user greater flexibility in selecting the communications device to be used.

In regard to the state of the art, we can cite patent ES No. 2,248,564, which refers to a microphone adapter for a respirator having a speech projector, characterized in that the adapter comprises a sound tube with a first open end designed to be placed in proximity to the sound projector of the breathing mask and a second open end designed to be attached to a microphone, wherein, in use the voice emanating from the speech projector can be transmitted via the sound tube to the microphone. The adapter of claim one, characterized by a microphone box in which the open second end of the sound tube terminates, the box said being arranged to fit over a microphone and shield the microphone from any incident sound other than those received via the second tube. The adapter of claim two, wherein the microphone is a boom microphone of a head assembly and that the microphone box is designed and arranged to be tightened so that it can release over the boom microphone.

BRIEF DESCRIPTION OF THE DRAWINGS

To better understand the main characteristics of the invention, for a communication system for respiratory protection equipment or the like, provided with means for transmitting and receiving both connected, either wired or wireless, it is described according to figures that form an integral part of the invention, wherein.

DETAILED DESCRIPTION OF THE INVENTION

Figure 1:
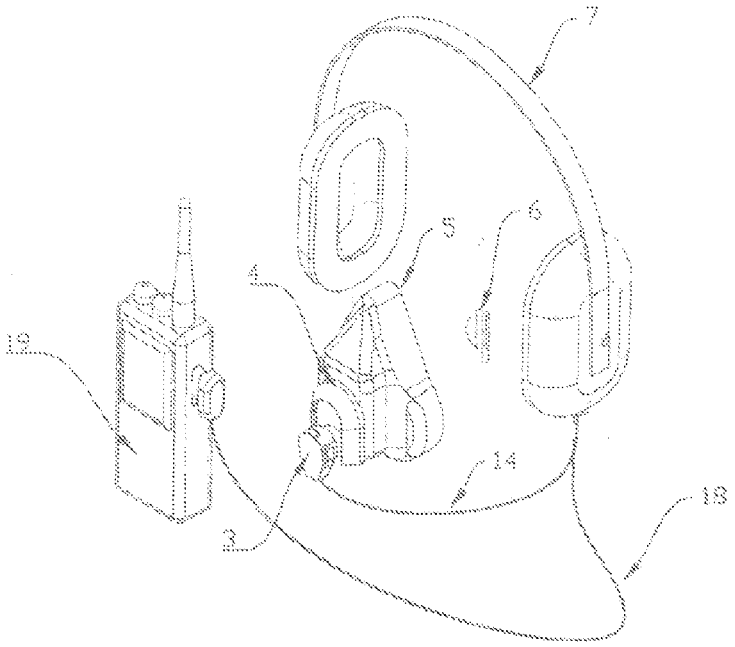
FIG. 1 shows a perspective view of the media set comprising the communication system.
Figure 2:
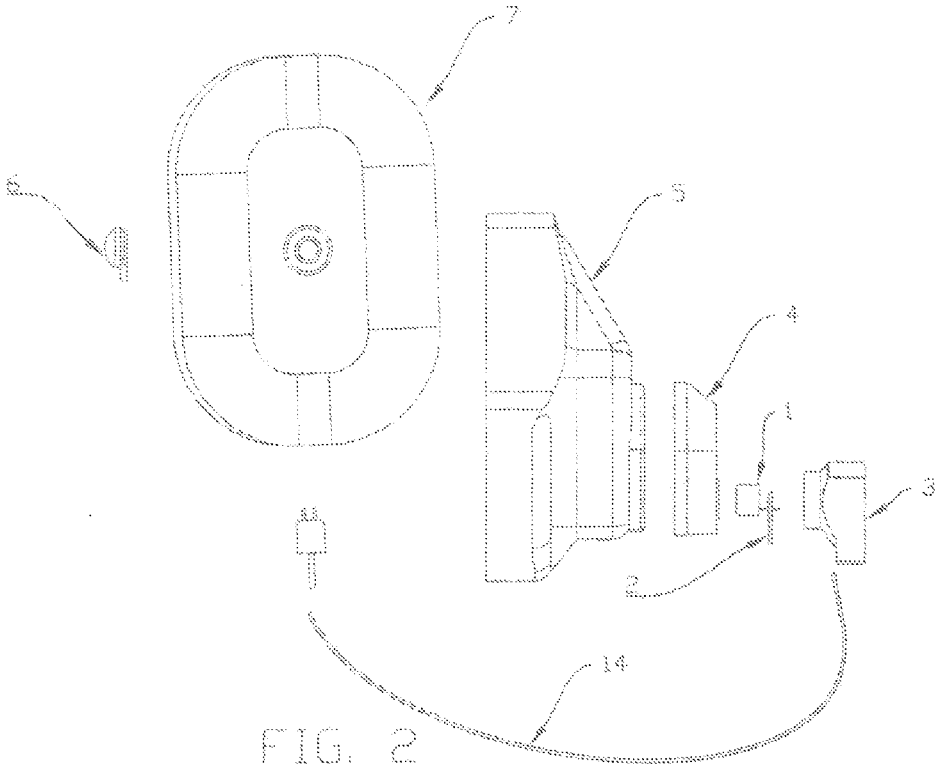
FIG. 2 shows an exploded view of the media which make the communication system.
Figure 3:
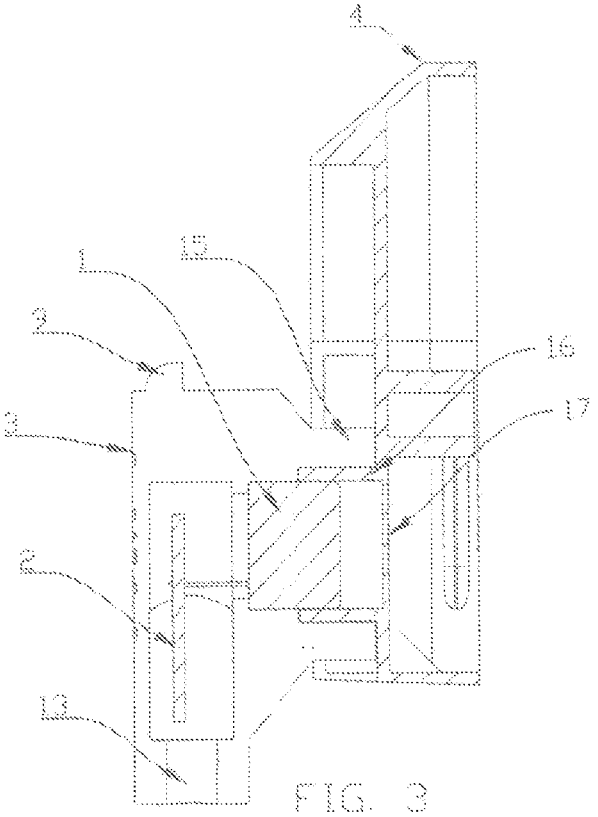
FIG. 3 shows a side longitudinal sectional view of the voice vibration adapter of microphone housing and breathing part of the communication system.
Figure 4:
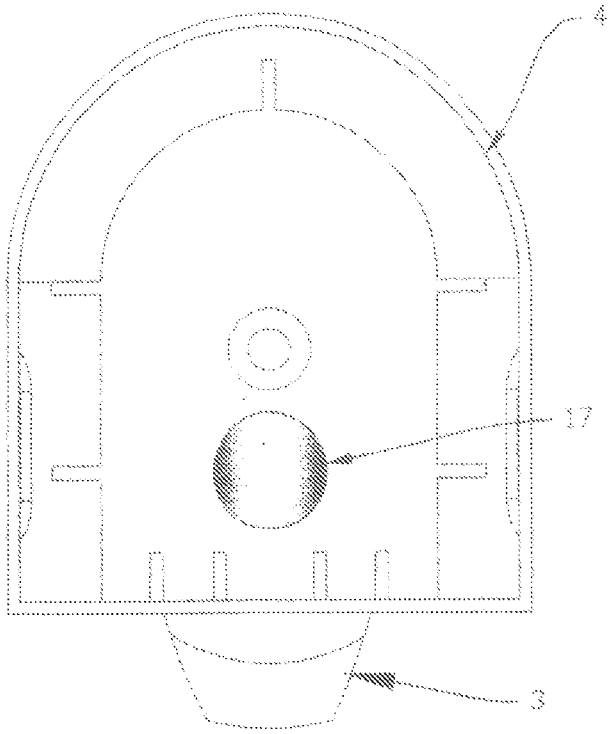
FIG. 4 shows a bottom plan view of the respiration part and for mounting voice vibration adapter and microphone housing of the communication system
Figure 5:
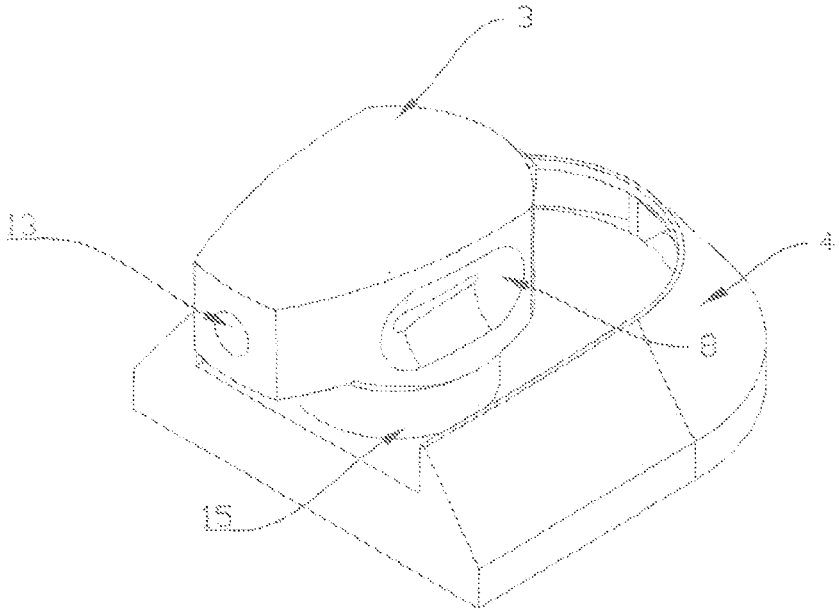
FIG. 5 shows a perspective view of a voice vibration adapter and of microphone housing, with the breathing part, of the communication system.
Figure 6:
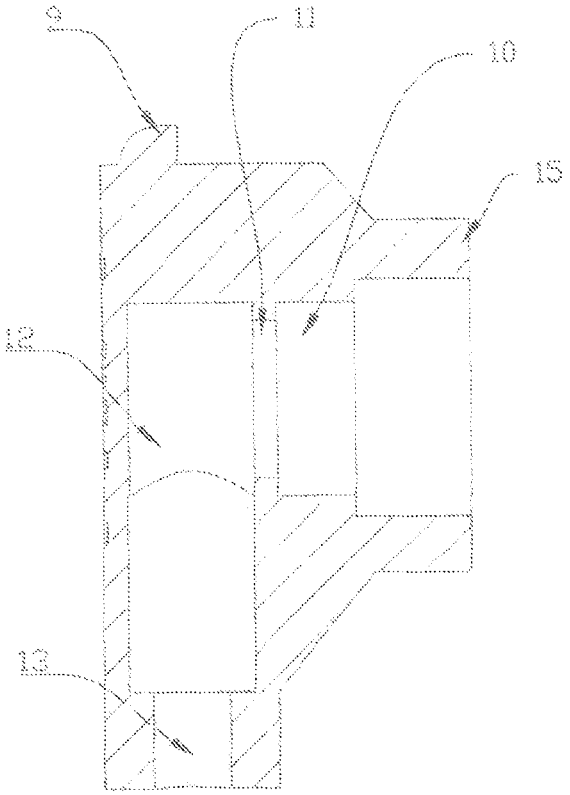
FIG. 6 shows a longitudinal sectional view of the vibration voice adapter and microphone housing of the communication system.
Figure 7:
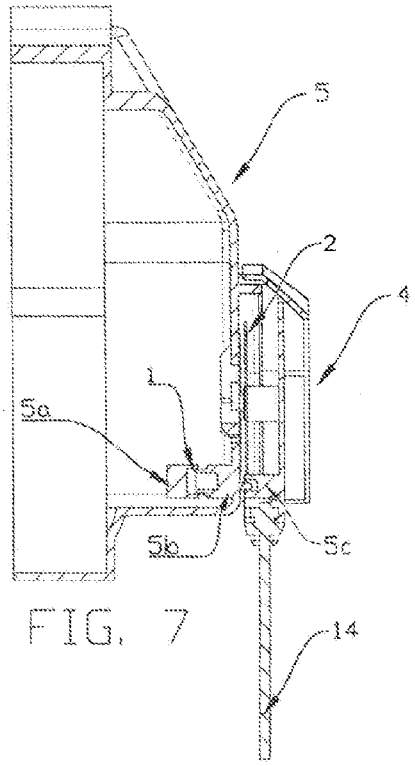
FIG. 7 shows a view in longitudinal section of a respiratory protection mask with microphone housing or capsule in a cavity inside the respirator mask.
Figure 8:
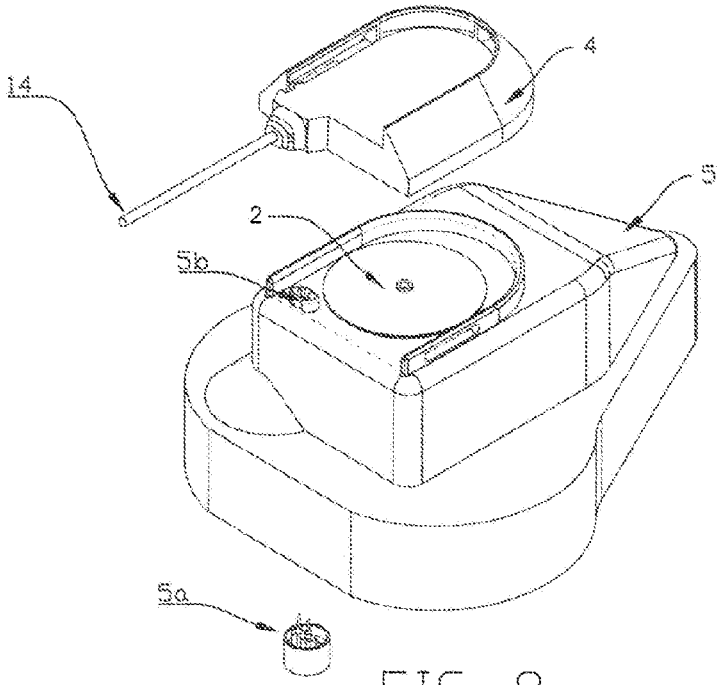
FIG. 8 shows a perspective view of respiratory protective mask with a breathing piece of double cable connection and double pin for microphone connection.

In response to FIGS. 1-8, the invention for a communication system for respiratory protection equipment or the like, comprising a microphone (1) with a plate with electronic components (2), both installed inside a voice vibration adapter (3) assembled in the frontal side of the respiration protector mask (5*a*). Said voice vibration adapter (3) is fixed in a respirator part (4) which in turn is assembled at the front of the respirator mask (5), furthermore, it has hearing aids (6) to be installed in the hearing protector (7) which are connected to that microphone (1).

The voice vibration adapter (3) for microphone housing (1) consists of a hollow prismatic outer body side grooves (8) and a front perimeter oblong protrusion (9), both (grooves and protrusions) allow disassembly or mounting of the voice vibration adapter (3), which is formed inside an insulating cavity (10) for housing the microphone (1), followed by other minor acoustic cavity (11), which connects with another larger cavity than the previous (12) and for housing the electronic components' plate (2) of the microphone (1); moreover, the voice vibration adapter (3), presents an outlet duct (13) of a two-channel connection cable (14) that connects to the headphones (6); finally said voice vibration adapter (3), presents in the lower base, a neck recess (15) which is assembled on in another lower neck recess (16) of smaller diameter, which is located on the upper base of the breathing piece (4), where it presents a thinning permeable sector or with microperforations (17) of that upper part of the breathing (4), allowing the projection of the voice transmission to the microphone (1) which adjoin with said hollow necks (15) and (16).

The respiration piece (4), is assembled or fixed in the frontal side of the respiratory protection mask (5) through a pressure or tongue-and-groove joint system, allowing removal or permanent fix.

The microphone (1), through the two-channel connection cable (14), is connected to the headset (6) of the hearing protector (7) and this, in turn, is connected by a four-channel connection cable (18), to a transmission radio (19), so the user can communicate with others, using radio transmission indirectly (19).

In the case of using the system in extreme noise environments, the microphone (1) is located within respiratory protection mask (5) with a protective capsule (5*a*), using this as a sound insulation from external noise and containing voice vibrations. The microphone (1) is connected by double pin (5*b*) to the respiratory protection mask (5) previously operated, and this is connected to the cover (4) using similar pin receivers (5*c*), which exit the cable (14) to the radio (15) or the like.

The invention claimed is:

1. A communication system for use in respiratory protection equipment, the communication system including:

a voice vibration adapter, the voice vibration adapter having a hollow outer body with an isolating cavity;

a microphone received into the isolating cavity;

a smaller cavity within the hollow outer body, the smaller cavity connected to the isolating cavity, the smaller cavity for providing an acoustic resonance;

a greater cavity within the hollow outer body, the greater cavity connected to the smaller cavity, and an electronic component of the microphone housed within the greater cavity;

the voice vibration adapter having an output duct with a two-channeled connection from the greater cavity and a headset connected to the two-channeled connection;

a transmitter inter connected to a receiver, the transmitter and the receiver for allowing a voice transmission from the microphone;

a neck recess of the hollow outer body of the voice vibration adapter assembled onto a lower hollow neck, the lower hollow neck located in an upper base respiration part of a breathing mask, the upper base respiration part fixed to a front face of the breathing mask; and the lower hollow neck of the breathing mask connected to a the voice vibration adapter to prevent a worker from removing the breathing mask to communicate.

2. The communication system for use in respiratory protection equipment according to claim 1, wherein the upper base respiration part has a permeable thinning at the lower hollow neck, allowing for a projection of a transmission of a voice directly to the microphone.

3. The communication system for use in respiratory protection equipment according to claim 2, wherein the permeable thinning at the lower hollow neck are a microperforation.

4. The communication system for use in respiratory protection equipment according to claim 1, wherein the voice vibration adapter is fixed to the upper base respiration part of a breathing mask with a tongue-and-groove joint system.

5. The communication system for use in respiratory protection equipment according to claim 1, wherein the voice vibration adapter is fixed to the upper base respiration part of a breathing mask with a pressure system.

6. The communication system for use in respiratory protection equipment according to claim 1, wherein:

the microphone is located within the front face of the breathing mask with a protective capsule, the protective capsule as a sound insulation to an external noise and the protective capsule for containing vibration of a voice communication to the microphone, the microphone connected by a double pin to the upper base the breathing mask with a pin receiver; and the two-channeled connection exiting from the pin receiver, to connect to the receiver and the transmitter.

7. The communication system for use in respiratory protection equipment according to claim 6, wherein the receiver and the transmitter are a radio.

8. The communication system for use in respiratory protection equipment according to claim 1, wherein the output duct of the two-channel connection has a cable channel, and the headset is connected to the cable channel of the two-channel connection.

9. The communication system for use in respiratory protection equipment according to claim 1, wherein the transmitter and the receiver allow a voice transmission, in a place having a high acoustic noise and a hazardous polluting emission.

10. The communication system for use in respiratory protection equipment according to claim 1, wherein the transmitter and the receiver are inter connected with a wireless connection.

11. A communication system for use in respiratory protection equipment, the communication system including:

a microphone with an electronic component installed inside a voice vibration adapter, the microphone and the voice vibration adapter assembled in the frontal side of a respiration protector mask;

the voice vibration adapter includes a hearing aid installed in a hearing protector, and the hearing aid inter-connected to the microphone;

the voice vibration adapter includes a hollow outer body, a hollow outer body having an insulating cavity for housing the microphone:

the insulating cavity followed by a minor acoustic cavity, and the minor acoustic cavity connects with a larger cavity the larger cavity for housing an electronic component plate of the microphone;

the voice vibration adapter includes an outlet duct for a two-channel connection cable that connects to a headphone, and the voice vibration adapter includes a neck recess assembled on a lower neck recess, the lower neck recess located on an upper base of the respiration protector mask, and the neck recess has a thinning permeable sector to provide for a projection of a voice transmission to the microphone.

12. The communication system for use in respiratory protection equipment according to claim 11, wherein the output duct of the two-channel connection has a cable channel, and the headset is connected to the cable channel of the two-channel connection.

13. The communication system for use in respiratory protection equipment according to claim 11, wherein the transmitter and the receiver allow a voice transmission, in a place having a high acoustic noise and a hazardous polluting emission.

14. The communication system for use in respiratory protection equipment according to claim 11, wherein the transmitter and the receiver are inter connected with a wireless connection.

15. The communication system for use in respiratory protection equipment according to claim 11, wherein the upper base respiration part has a permeable thinning at the lower hollow neck, allowing for a projection of a transmission of a voice directly to the microphone.

16. The communication system for use in respiratory protection equipment according to claim 15, wherein the permeable thinning at the lower hollow neck are a microperforation.

17. The communication system for use in respiratory protection equipment according to claim 11, wherein the voice vibration adapter is fixed to the upper base of a breathing mask with a tongue-and-groove joint system.

18. The communication system for use in respiratory protection equipment according to claim 11, wherein the voice vibration adapter is fixed to the upper base of a breathing mask with a pressure system.

19. The communication system for use in respiratory protection equipment according to claim 11, wherein:

the microphone is located within the front face of the breathing mask with a protective capsule, the protective capsule as a sound insulation to an external noise and the protective capsule for containing vibration of a voice communication to the microphone, the microphone connected by a double pin to the upper base the breathing mask with a pin receiver; and the two-channeled connection exiting from the pin receiver, to connect to the receiver and the transmitter.

20. The communication system for use in respiratory protection equipment according to claim 19, wherein the receiver and the transmitter are a radio.

* * * * *